US007451702B1

(12) United States Patent
Dindl et al.

(10) Patent No.: US 7,451,702 B1
(45) Date of Patent: Nov. 18, 2008

(54) ELECTRICALLY-FIRED MULTIPLE PROJECTILE LARGE CALIBER ROUND

(75) Inventors: Frank Dindl, Newton, NJ (US); Peter Georgantzis, East Stroudsburg, PA (US); Hugh MacMillan, Stanhope, NJ (US); Kenneth Jones, Wayne, NJ (US); Richard Beckman, Randolph, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 142 days.

(21) Appl. No.: 11/279,583

(22) Filed: Apr. 13, 2006

Related U.S. Application Data

(60) Provisional application No. 60/594,512, filed on Apr. 14, 2005.

(51) Int. Cl.
*F42B 5/08* (2006.01)
*F42B 12/62* (2006.01)
*F41A 19/58* (2006.01)

(52) U.S. Cl. ..... 102/472; 102/438; 89/28.05

(58) Field of Classification Search ..... 102/438, 102/472, 502, 503; 89/1.814, 28.05, 28.1

See application file for complete search history.

(56) References Cited

U.S. PATENT DOCUMENTS

| | | | | | |
|---|---|---|---|---|---|
| 694,896 | A * | 3/1902 | Scott | 102/438 |
| 2,767,656 | A * | 10/1956 | Zeamer | 102/438 |
| 3,815,271 | A * | 6/1974 | Lynn | 42/84 |
| 3,884,118 | A * | 5/1975 | Taylor et al. | 89/1.814 |
| 3,952,658 | A * | 4/1976 | Broyles | 102/438 |
| 4,068,556 | A * | 1/1978 | Foley | 89/1.814 |
| 4,285,153 | A * | 8/1981 | Crouch | 42/84 |
| 4,791,870 | A * | 12/1988 | Simpson | 102/342 |
| 5,058,481 | A * | 10/1991 | Drummond et al. | 89/1.816 |
| 6,543,174 | B2 * | 4/2003 | O'Dwyer | 42/76.01 |
| 7,194,943 | B2 * | 3/2007 | O'Dwyer | 89/28.05 |
| 7,240,601 | B2 * | 7/2007 | O'Dwyer | 89/127 |

* cited by examiner

*Primary Examiner*—Bret Hayes
(74) *Attorney, Agent, or Firm*—John F. Moran

(57) ABSTRACT

An electrically-fired round includes a case sized to fit in a conventional large caliber gun; a launch tube disposed in the case; a plurality of projectiles axially stacked in the launch tube; each projectile comprising a cylindrical body having a circular lid that closes the forward end and a circular base that closes the rear end, the circular lid and the circular base defining a payload volume therebetween, the circular base including a cavity formed therein, a propellant charge disposed in the cavity, and an igniter disposed in the propellant charge; a case base plate that closes a rear end of the case; and electrical connections between the case base plate and each igniter.

20 Claims, 8 Drawing Sheets

ELECTRICALLY-FIRED MULTIPLE PROJECTILE LARGE CALIBER ROUND

CROSS-REFERENCE TO RELATED APPLICATIONS

This application claims the benefit under 35 USC 119(e) of U.S. provisional patent application No. 60/594,512 filed on Apr. 14, 2005, which application is hereby incorporated by reference.

STATEMENT OF GOVERNMENT INTEREST

The inventions described herein may be manufactured, used and licensed by or for the U.S. Government for U.S. Government purposes.

BACKGROUND OF THE INVENTION

The invention relates in general to munitions and, more particularly, to an electrically-fired, gun-launched round that contains a plurality of projectiles therein.

Traditional non-lethal ordnance comprises cartridges containing, for example, metal balls coated with a thin layer of plastic or rubber, fabric bags which are filled with lead shot (so-called "bean bags"), and "rubber balls" formed of hard rubber, foam, plastic or wood. When dealing with a large number of people, such as an unruly crowd, many non-lethal cartridges must be fired in a short period of time to have much effect. Traditional delivery systems for non-lethal cartridges may fire one or a few cartridges before reloading is needed. Thus, a large number of weapons and a large number of weapon users are required. When the large number of people comprise an enemy military force that is close in, there is also a need for a short range cartridge that is lethal to a large group of combatants.

Some military operations require use of both lethal and non-lethal force. The U.S. Army has formidable lethal guns, such as tanks and large caliber guns. However, when a non-lethal force is needed, these valuable assets are useless. Therefore, there is a need for a non-lethal round that can be fired from a conventional gun, such as a tank or a large caliber piece, without any modifications to the conventional gun.

U.S. Pat. No. 5,883,329 discloses barrel assemblies loaded with a plurality of projectiles. However, the disclosed projectiles are not suited for non-lethal applications. Furthermore, the barrels are not suited for use with a conventional large caliber gun. Many of the projectiles require an axial support member, which limits the volume of the payload space available in each projectile.

SUMMARY OF THE INVENTION

It is an object of the invention to provide an electrically-fired round that can be used in a conventional large caliber gun, such as, for example, a 120 mm gun.

It is another object of the invention to provide an electrically-fired round that can carry either lethal or non-lethal payload.

It is a further object of the invention to provide an electrically-fired round containing multiple projectiles.

One aspect of the invention is an electrically-fired round comprising a case sized to fit in a conventional large caliber gun; a launch tube disposed in the case; a plurality of projectiles axially stacked in the launch tube; each projectile comprising a cylindrical body having a circular lid that closes the forward end and a circular base that closes the rear end, the circular lid and the circular base defining a payload volume therebetween, the circular base including a cavity formed therein, a propellant charge disposed in the cavity, and an igniter disposed in the propellant charge; a case base plate that closes a rear end of the case; and electrical connections between the case base plate and each igniter.

The round may further comprise additional launch tubes disposed in the case, each additional launch tube containing a plurality of projectiles axially stacked therein; each projectile comprising a cylindrical body having a circular lid that closes the forward end and a circular base that closes the rear end, the circular lid and the circular base defining a payload volume therebetween, the circular base including a cavity formed therein, a propellant charge disposed in the cavity, and an igniter disposed in the propellant charge.

The round may include a lethal or a non-lethal payload disposed in each payload volume.

In one embodiment, the cylindrical body of each projectile includes at least one longitudinal groove formed therein.

Another aspect of the invention is a method comprising providing a conventional large caliber gun having an electrical pulse firing mechanism; loading the gun with the round described herein; and operating the firing mechanism of the gun in a conventional manner.

A further aspect of the invention is an electrically-fired round comprising a case sized to fit in a conventional large caliber gun; a launch tube disposed in the case; a plurality of projectiles axially stacked in the launch tube; each projectile comprising a cylindrical body having a circular lid that closes the forward end and a circular base that closes the rear end, the circular lid and the circular base defining a payload volume therebetween, the circular base including a cavity formed therein with a propellant charge disposed in the cavity; the launch tube including openings in its sidewall, the openings being disposed adjacent propellant charges of the projectiles, each opening including an igniter; a case base plate that closes a rear end of the case; and electrical connections between the case base plate and each igniter.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

Figure 1:
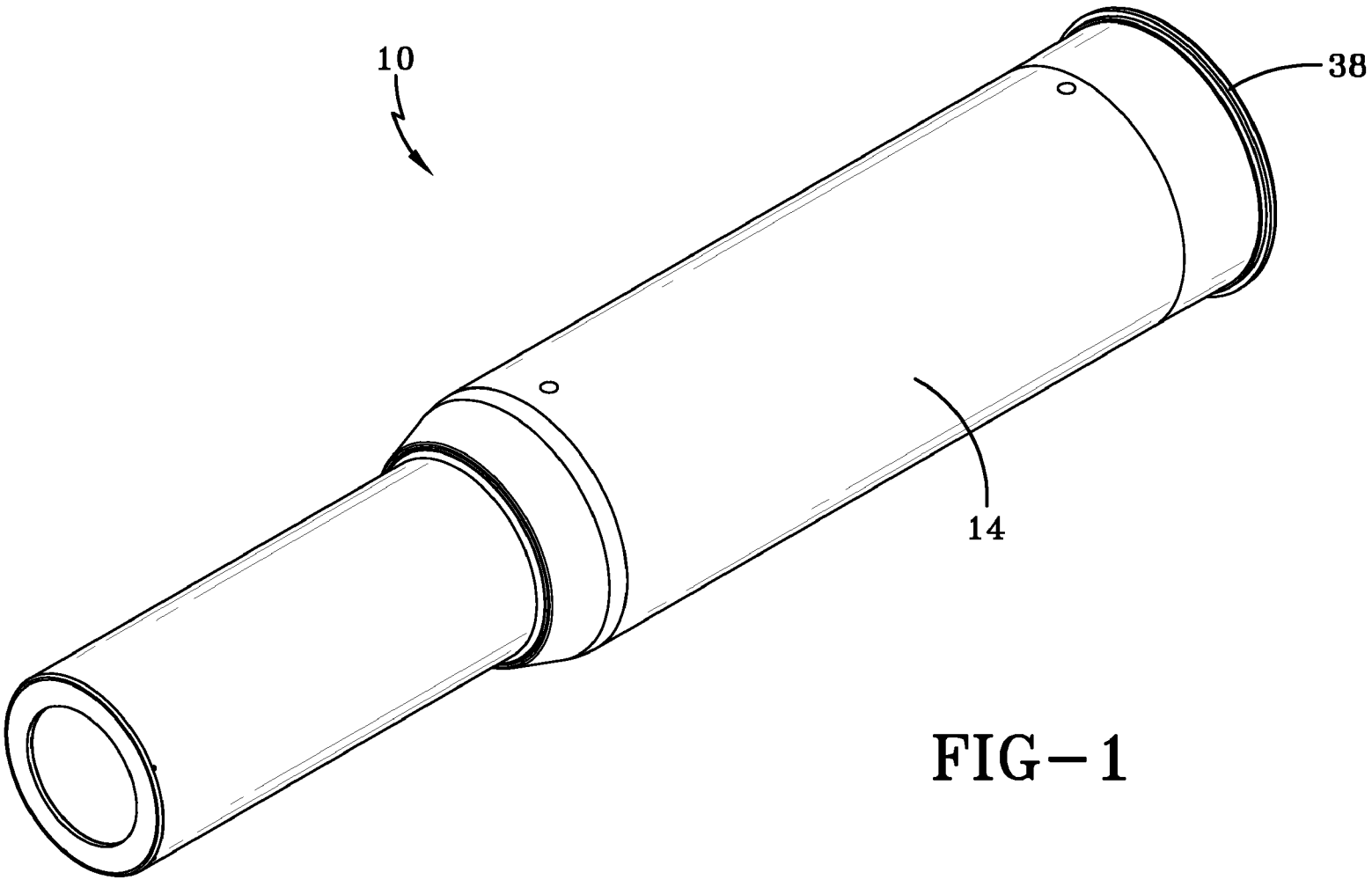
FIG. 1 is a perspective view of one embodiment of a round of the invention.
Figure 2:
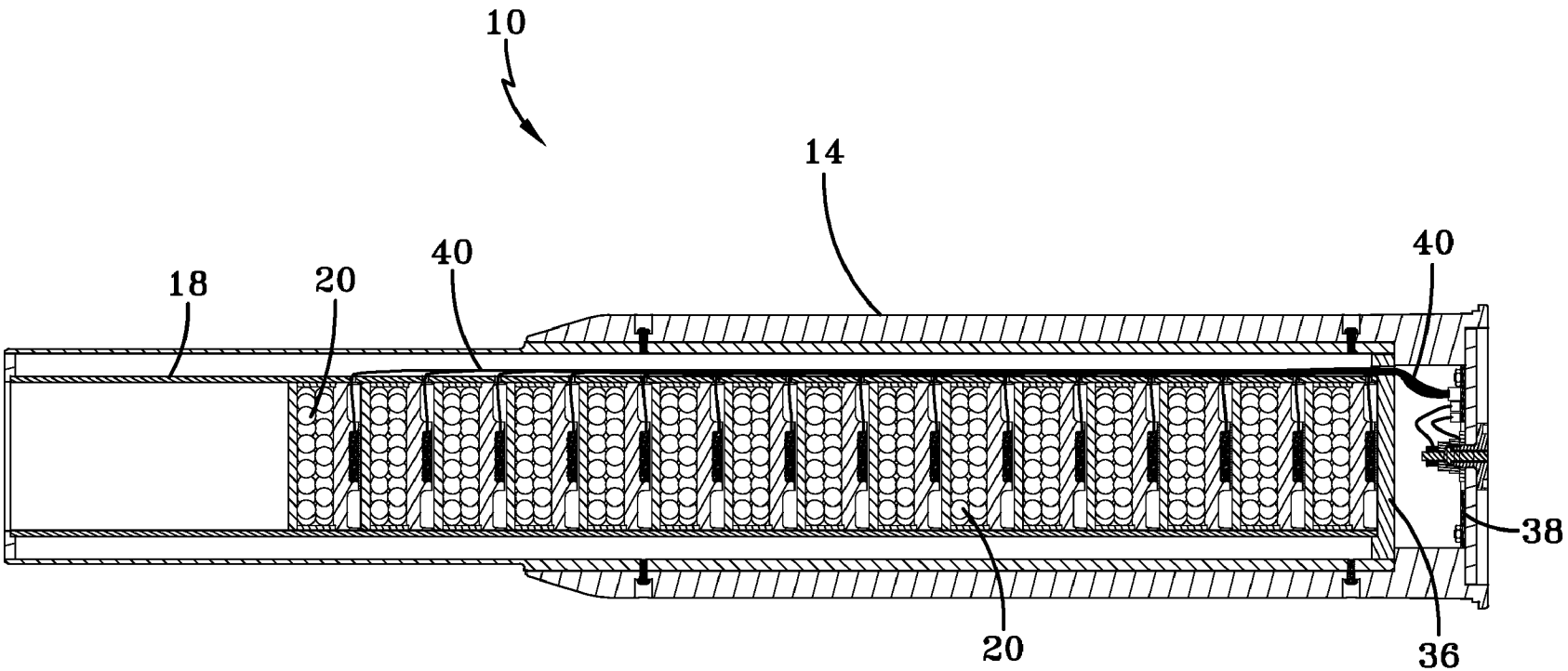
FIG. 2 is a sectional view of FIG. 1.

FIG. 1 is a perspective view of one embodiment of a round 10 in accordance with the invention. FIG. 2 is a sectional view of FIG. 1. The electrically-fired round 10 includes a case 14. The case 14 is sized to fit in a conventional large caliber gun, such as a 120 mm gun, for example, and can be loaded and fired from the conventional gun. A launch tube 18 is disposed in the case 14. A case base plate 38 closes the rear end of the case 14. A bulkhead 36 may be provided for closing launch tube 18 and supporting it in the case 14. A plurality of projectiles 20 are axially stacked in the launch tube 18. The bore of launch tube 18 may be smooth or may be rifled. Case 14 may be made of, for example, steel, brass or plastics.

Figure 3B:
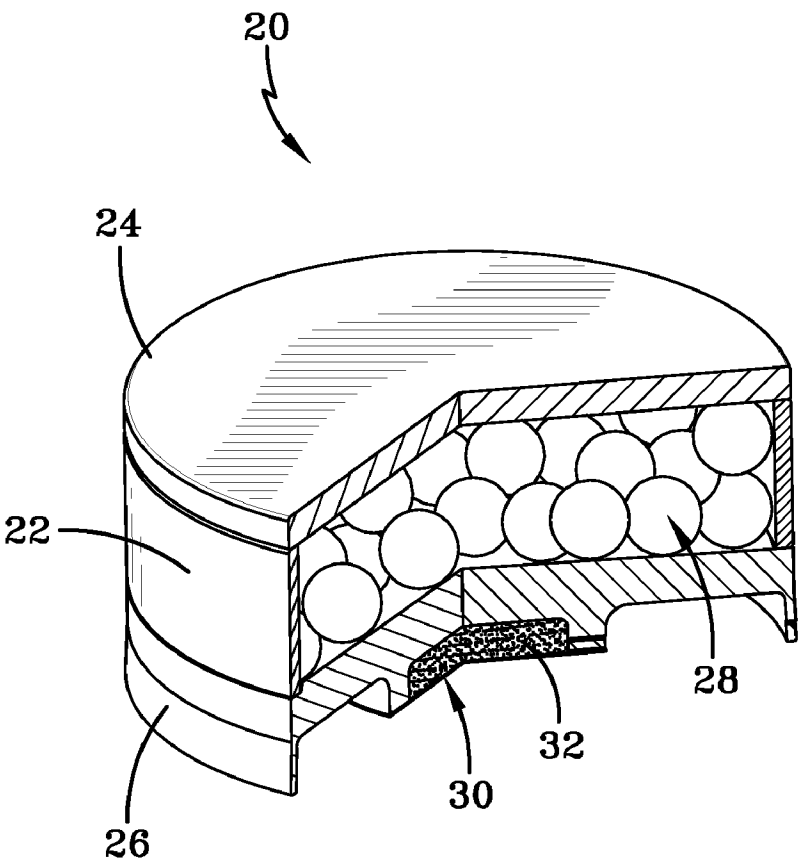
FIG. 3B is a partially cutaway view of FIG. 3A.
Figure 3A:
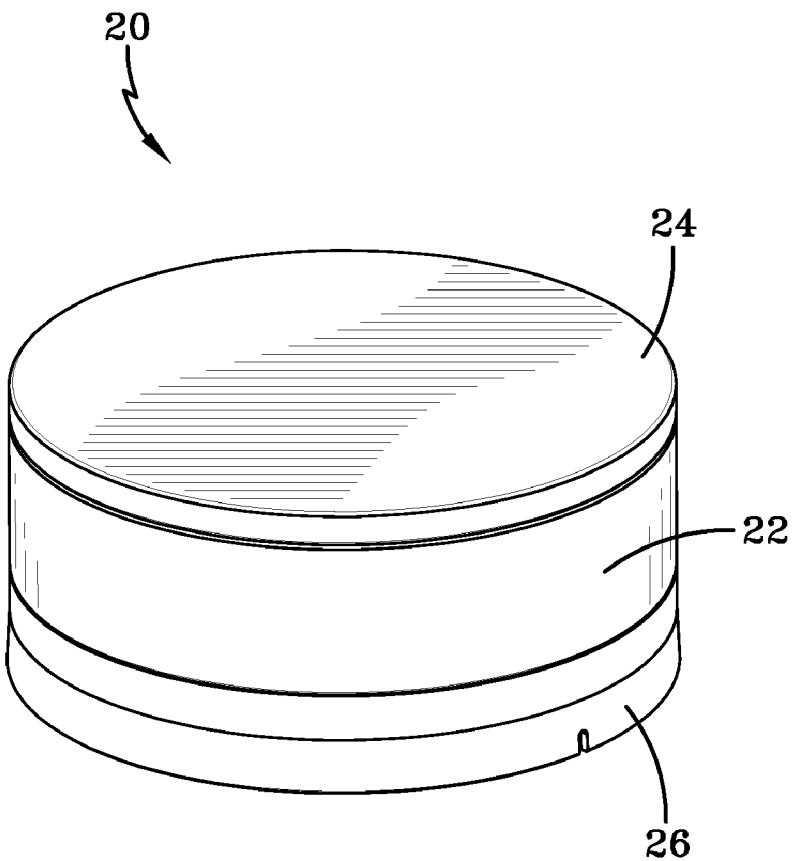
FIG. 3A is a perspective view of one embodiment of a projectile of the invention.

FIG. 3A is a perspective view of one embodiment of a projectile 20 of the invention. FIG. 3B is a partially cutaway view of FIG. 3A. Each projectile 20 includes a cylindrical body 22 having a circular lid 24 that closes the forward end and a circular base 26 that closes the rear end. The circular lid 24 and the circular base 26 define a payload volume 28 therebetween. The circular base 26 includes a cavity 30 formed therein. A propellant charge 32 is disposed in the cavity 30 and an igniter (not shown) is disposed in the propellant charge 32. Electrical wires 40 (FIG. 2) connect the outer case base plate 38 with each igniter. Because only a single launch tube 18 is disposed in the case 14, the projectiles 20 may have a comparatively large diameter.

Figures 4A, 4B:
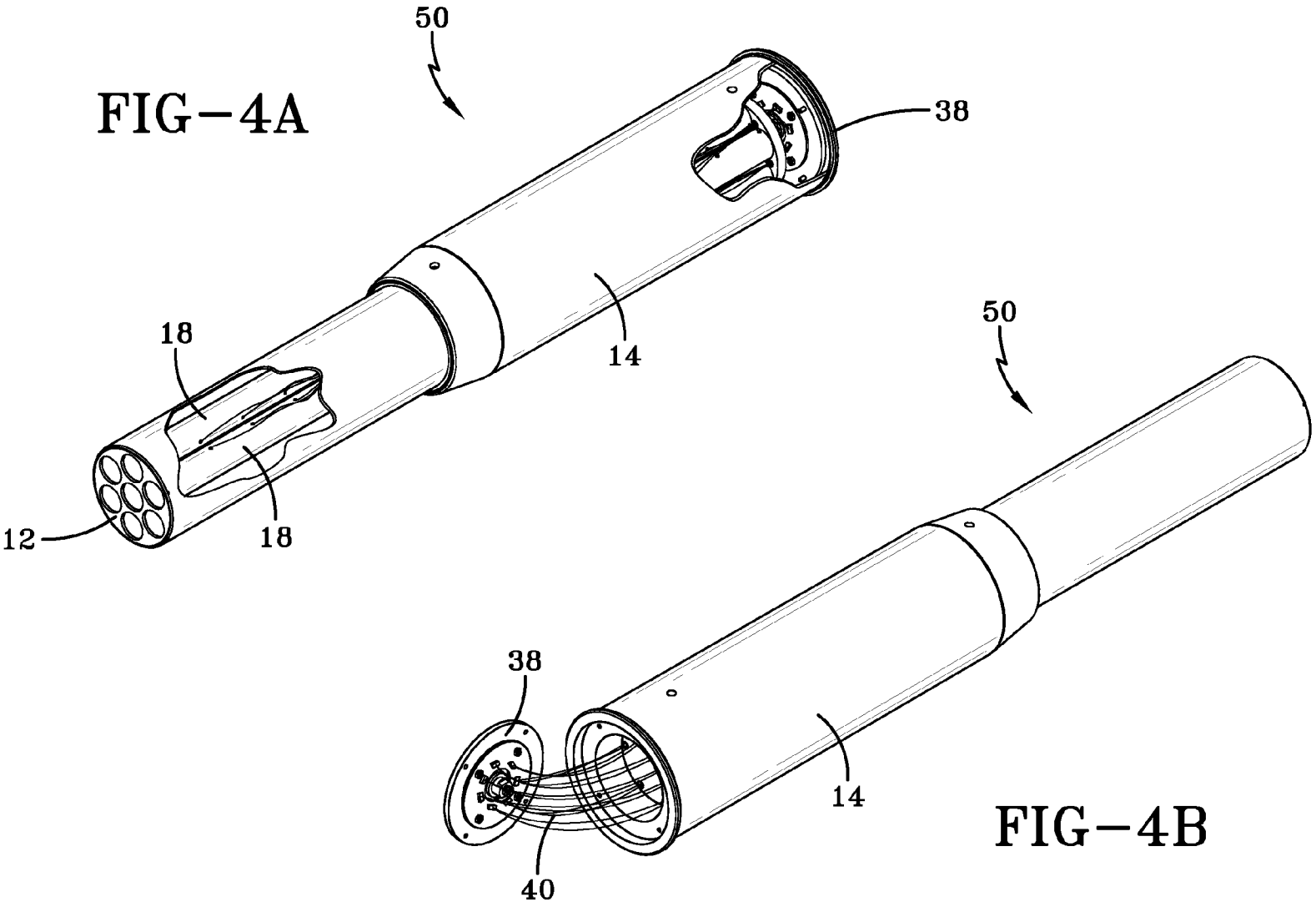
FIG. 4A is a partially cutaway perspective view of another embodiment of a round.
FIG. 4B is a perspective view of the round of FIG. 4A.

FIG. 4A is a partially cutaway perspective view of another embodiment of a round 50 in accordance with the invention. FIG. 4B is a perspective view of the round 50 of FIG. 4A. The construction of round 50 is very similar to round 10, except that round 50 includes multiple launch tubes. Round 50 includes case 14 and case base plate 38. A plurality of launch tubes 18 are disposed in the case 14. Given the same size case 14, the plurality of launch tubes 18 in round 50 have smaller diameters than the single launch tube 18 in round 10. One or more manifolds 12 (FIG. 4A) may be used to space the launch tubes 18.

Figure 5A:
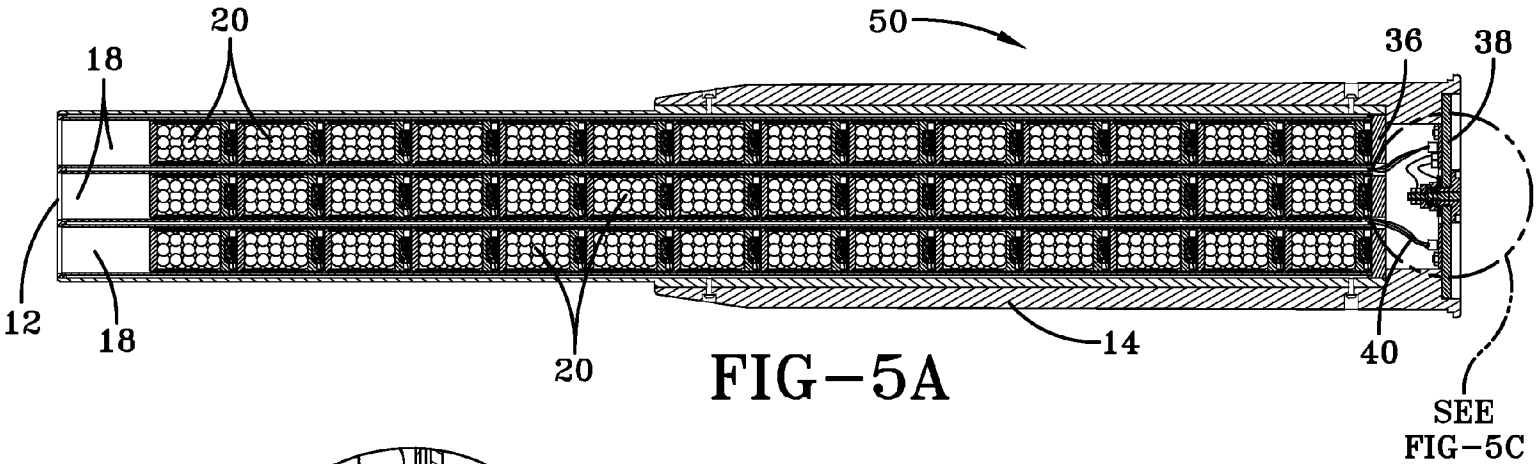
FIG. 5A is a sectional view of the round of FIGS. 4A and B.
Figure 5C:
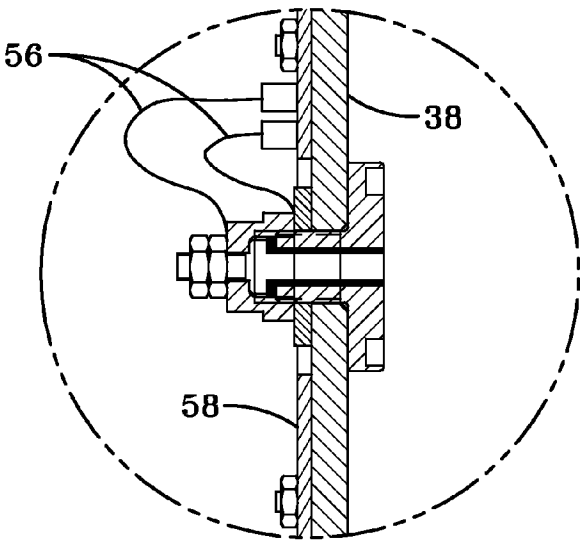
FIG. 5C is an enlarged view of another portion of FIG. 5A.
Figure 5B:
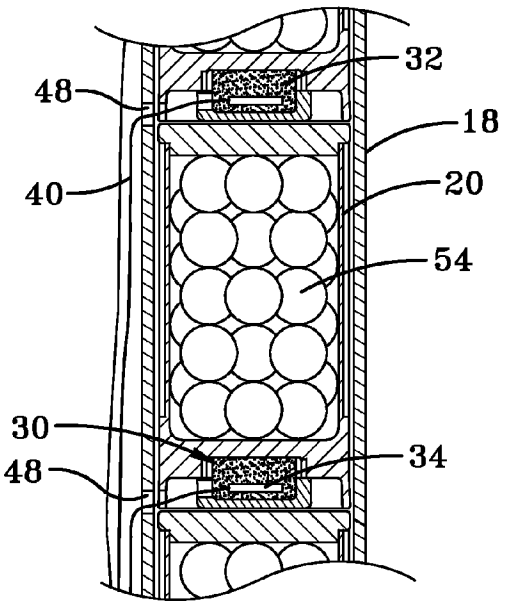
FIG. 5B is an enlarged view of a portion of FIG. 5A.

FIG. 5A is a sectional view of the round 50 of FIGS. 4A and B. FIG. 5B is an enlarged view of a portion of FIG. 5A. Each launch tube 18 contains a plurality of projectiles 20 axially stacked therein. Projectiles 20 are the same as described before, except for their size. The projectiles that are used in round 50 having multiple launch tubes will, in general, be of a smaller diameter and longer length than the projectiles used in round 10 having a single launch tube.

Figure 6A:
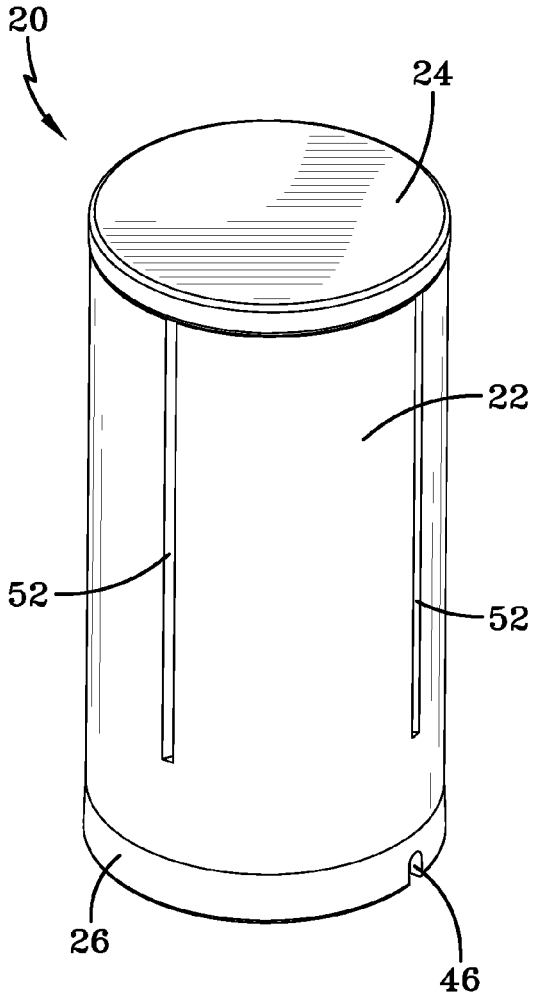
FIG. 6A is a perspective view of a projectile.
Figure 6B:
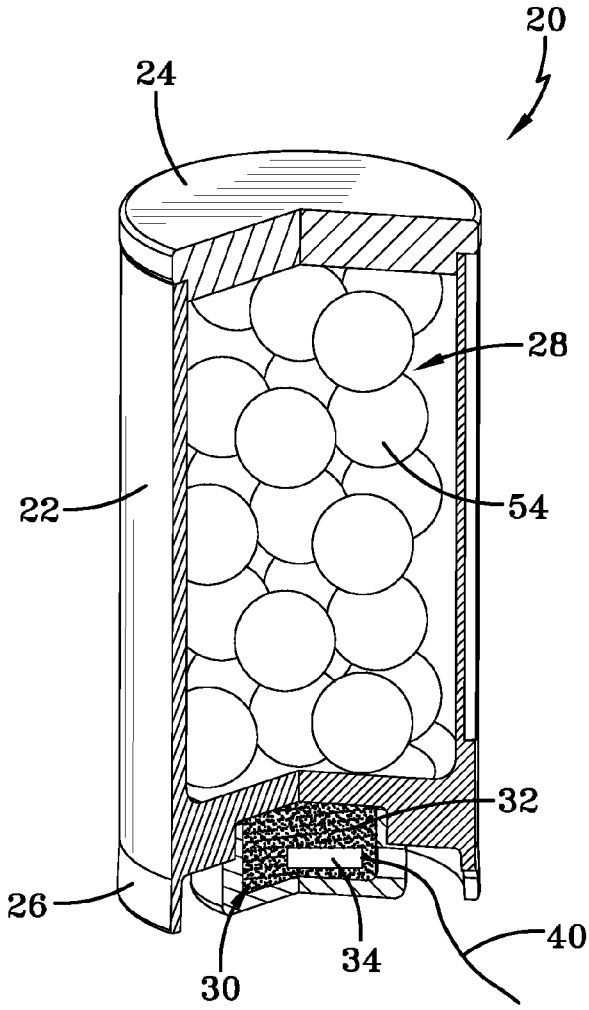
FIG. 6B is a partially cutaway view of FIG. 6A.

FIG. 6A is a perspective view of a projectile 20 used in the round 50. FIG. 6B is a partially cutaway view of FIG. 6A. Each projectile 20 comprises a cylindrical body 22 having a circular lid 24 that closes the forward end and a circular base 26 that closes the rear end. The circular lid 24 and the circular base 26 define a payload volume 28 therebetween. The circular base 26 includes a cavity 30 formed therein. A propellant charge 32 is disposed in the cavity 30 and an igniter 34 is disposed in the propellant charge 32. Electrical wires 40 connect the outer case base plate 38 with each igniter. The projectile body 22, lid 24 and base 26 may be formed of a polyolefin, for example, high density polyethylene or polypropylene. However, any other material can be used, providing the material can withstand the hot propellant gases and compressive loads required to support the projectile during firing.

Payload volume 28 may be filled with a lethal or non-lethal payload. An example of a non-lethal payload is one or more hard rubber balls 54. An example of a lethal payload is shards of metal. The circular base 26 of each projectile 44 includes an opening 46 for an electrical wire 40 connected to the igniter 34. Each launch tube 18 includes openings 48 (FIG. 5B) for the electrical wires 40 that are connected to the igniters 34 at first ends and to the case base plate 38 at second ends.

Figure 6C:
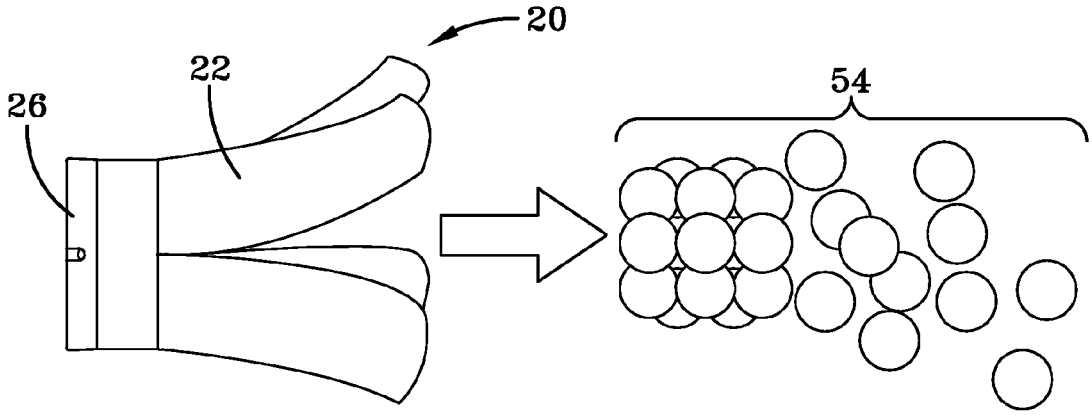
FIG. 6C shows the projectile of FIG. 6A after exiting the gun muzzle.

As shown in FIG. 6A, the cylindrical body 22 of each projectile 20 may include at least one longitudinal groove 52 formed therein. Grooves 52 are formed on the external surface of body 22 and comprise areas of reduced wall thickness. The grooves 52 can have a variety of shapes. The purpose of the grooves 52 is to help body 22 split and deform after it leaves the launch tube 42. The body 22 will split at grooves 52 and peel back, thereby allowing the payload therein to disperse. FIG. 6C shows the projectile 20 after exit from the gun muzzle. Of course, projectiles 20 may be constructed without grooves 52.

An important advantage of the invention is that the rounds 20, 50 can be used in a conventional gun without any modifications to the gun. For example, in the case of a 120 mm tank gun, the gun operator pushes a button or trigger that sends an electrical pulse to the gun breech. When using rounds 20 or 50, this electrical pulse is received by a circuit at the case base plate 38. FIG. 5C is an enlarged view of a portion of the case base plate 38. The electric trigger pulse travels through wires 56 that are connected to a circuit board 58. Circuit board 58 is mounted inside case base plate 38. Wires 40 from all the igniters 34 in all the projectiles 20 also connect to the circuit board 58.

Figure 7:
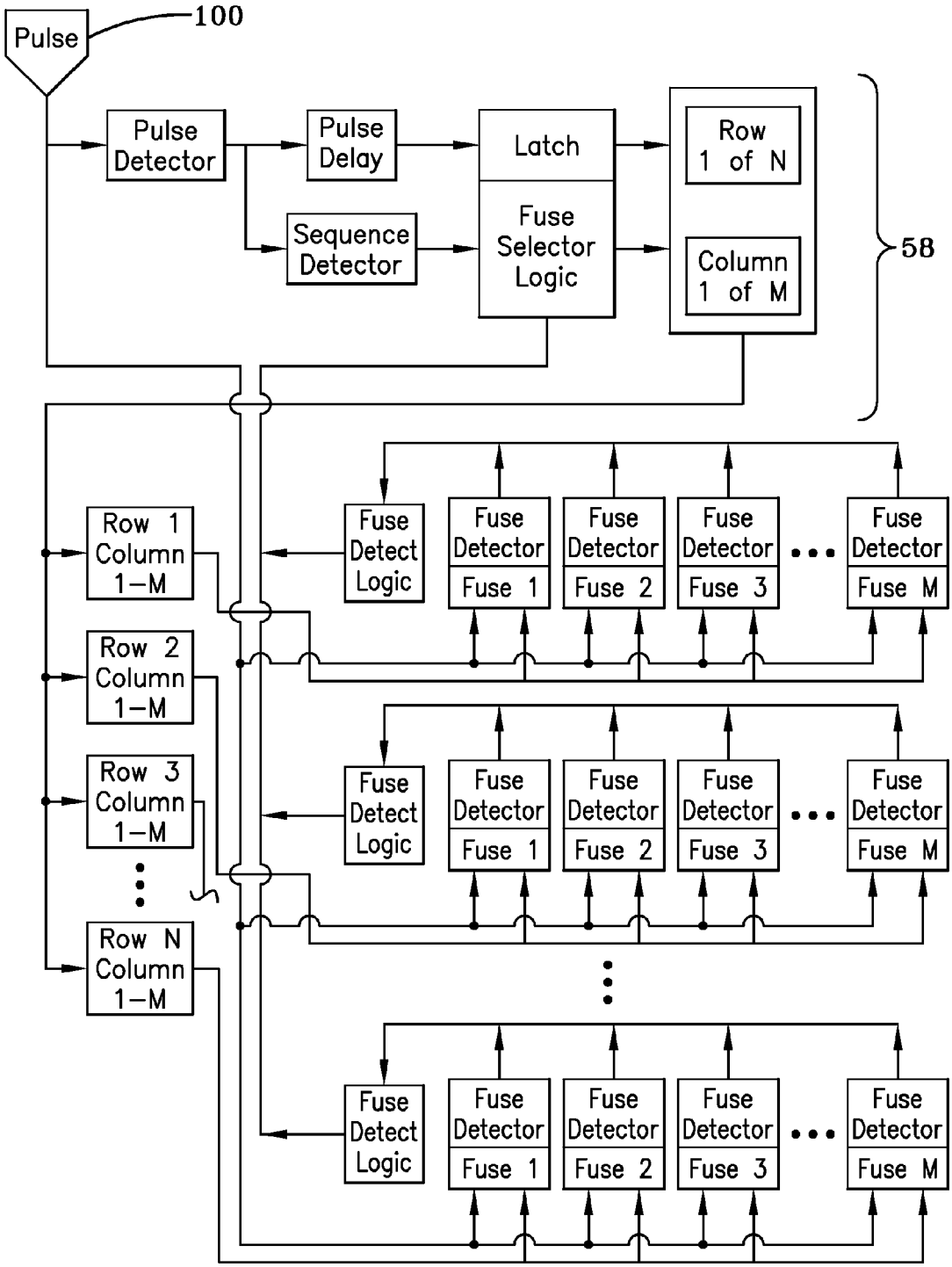
FIG. 7 is a circuit diagram showing one embodiment of a firing circuit.

FIG. 7 is a circuit diagram showing one embodiment of a firing circuit for a round 20 or 50. Pulse 100 is generated by the tank gunner in the conventional manner of firing a round. All electrical power used by the rounds 20, 50 is supplied by the tank pulse 100. No separate power source is required in the rounds 20, 50. Circuit board 58 includes a pulse detector, a pulse delay, a sequence detector, a latch and fuse selector logic. The fuse selector logic may be, for example, a programmable microprocessor or a hard-wired circuit. The firing logic denotes each launch tube 18 as a "row" and each projectile 20 as a "column." Thus, there may be N rows and M columns. In the case of a single launch tube in round 20, the number of rows N is one.

In FIG. 7, use of the word "fuse" refers to an igniter 34 in a projectile 20. Each igniter or fuse 34 is wired directly to the circuit board 58. The rounds 20, 50 fire a single projectile 20 per pulse 100. The wires leading to each igniter are sheared off when its respective projectile is fired. In one mode, a launch tube 18 can have all its projectiles 20 sequentially fired before moving to another launch tube 18. In another mode, the forward most projectile in each tube may be sequentially fired, then the next forward most, etc.

An important feature of the circuit board 58 is its static memory. The static memory requires no power. Thus, a round 50 may be loaded, fired several times and then removed from the gun and stored. When the round 50 is taken from storage and reloaded in the gun, the static memory of the circuit board 58 will "remember" which projectile is to be fired next. Of course, other firing methods may be hard-wired or programmed into the circuit board 58.

In one exemplary embodiment, seven 40 mm launch tubes 18 are used in an electrically-fired 120 mm tank gun. Each projectile 20 contains about 40 dense rubber balls 54. The propellant charge 32 is chosen to propel the rubber balls 54 to a muzzle velocity of about 400-500 ft/sec. An exemplary volume of propellant is 0.5 grams of smokeless propellant. The rubber balls 54 are effective as a non-lethal weapon for distances of about 50-100 meters from the tank gun.

Figure 8:
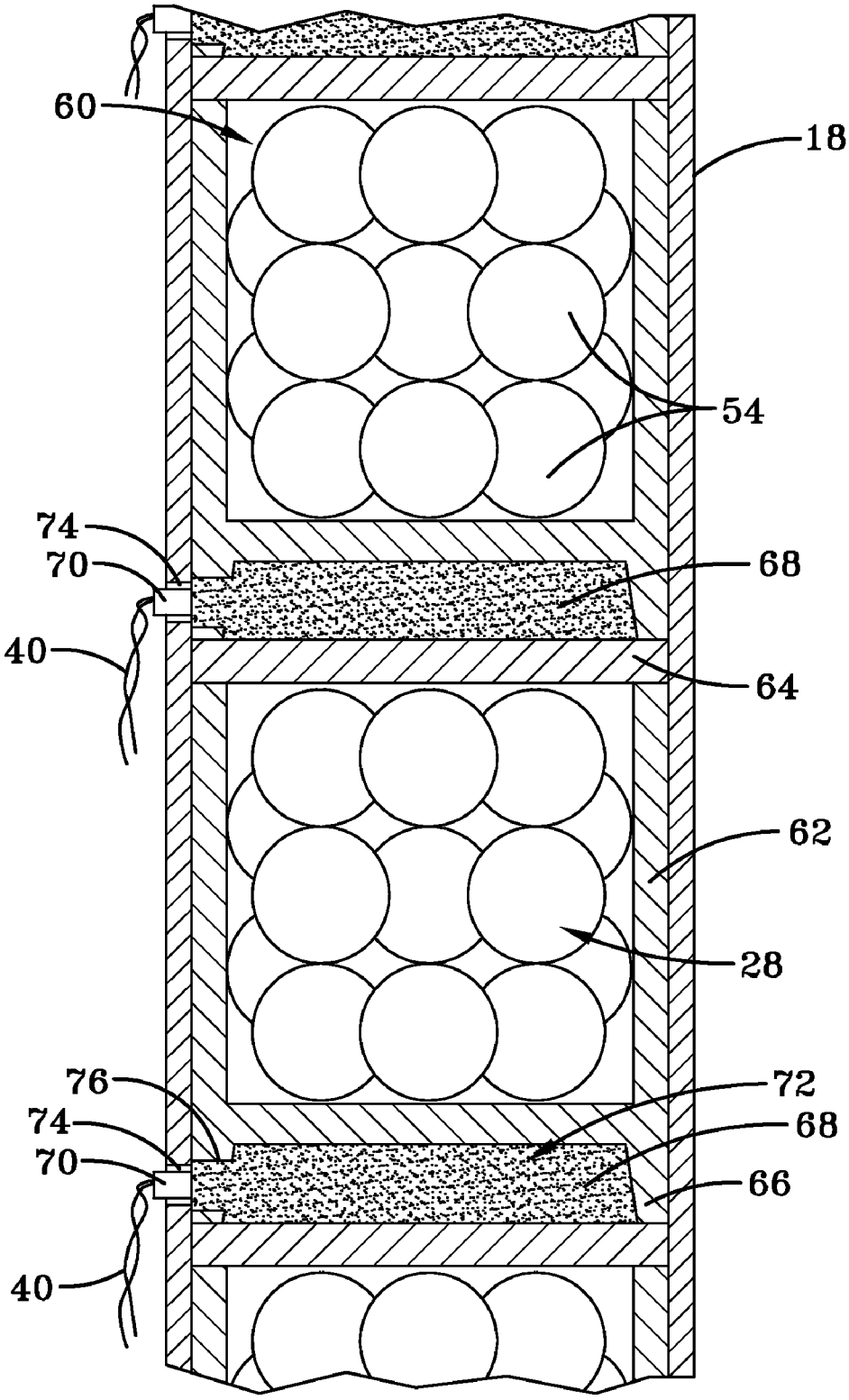
FIG. 8 is a cutaway view of another embodiment of a projectile.

FIG. 8 is a cutaway view of another embodiment of a projectile 60 for use in an electrically-fired round. Projectiles 60 are axially stacked in one or more launch tubes 18 that are disposed in a case 14. Each projectile 60 includes a cylindrical body 62 having a circular lid 64 that closes the forward end and a circular base 66 that closes the rear end. The circular lid 64 and the circular base 66 define a payload volume 28 therebetween. The payload may be, for example, balls 54. The circular base 66 includes a cavity 72 formed therein with a propellant charge 68 disposed in the cavity 72.

The launch tube 18 including openings 74 in its sidewall. The openings 74 are disposed adjacent respective propellant charges 68 of the projectiles 60. The circular base 66 may include a notched portion 76 also filled with propellant 68. The propellant in the notched portion 76 is adjacent the opening 74 in the tube 18. An igniter 70 is disposed in or over each opening 74. Electrical connections between the case base plate 38 and each igniter 70 may comprise wires 40. In this embodiment, it is not necessary to thread wires 40 into the launch tube 18 because the igniters 70 are not inside the launch tube 18. One or more launch tubes 18 may be loaded with projectiles 60 and inserted in a case 14, as described before.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. An electrically-fired round, comprising:

a case sized to fit in a conventional gun;

a launch tube disposed in the case;

a plurality of projectiles axially stacked in the launch tube;

each projectile comprising a cylindrical body having a circular lid that closes the forward end and a circular base that closes the rear end, the circular lid and the circular base defining a payload volume therebetween, the circular base including a cavity formed therein, a propellant charge disposed in the cavity, and an igniter disposed in the propellant charge;

a case base plate that closes a rear end of the case; and electrical connections between the case base plate and each igniter.

2. The round of claim 1 further comprising additional launch tubes disposed in the case, each additional launch tube containing a plurality of projectiles axially stacked therein; each projectile comprising a cylindrical body having a circular lid that closes the forward end and a circular base that closes the rear end, the circular lid and the circular base defining a payload volume therebetween, the circular base including a cavity formed therein, a propellant charge disposed in the cavity, and an igniter disposed in the propellant charge.

3. The round of claim 2 further comprising a lethal payload disposed in each payload volume.

4. The round of claim 3 wherein the lethal payload comprises shards of metal.

5. The round of claim 2 further comprising a non-lethal payload disposed in each payload volume.

6. The round of claim 5 wherein the non-lethal payload comprises one or more rubber balls.

7. The round of claim 2 wherein the circular base of each projectile includes an opening for an electrical wire connected to the igniter.

8. The round of claim 7 wherein each launch tube includes openings for the electrical wires that are connected to the igniters at first ends and to the case base plate at second ends.

9. The round of claim 2 wherein the cylindrical body of each projectile includes at least one longitudinal groove formed therein.

10. The round of claim 2 wherein the cylindrical body, circular lid and circular base of each projectile comprise high density polyolefin.

11. The round of claim 2 further comprising a circuit board attached to an inner surface of the case base plate and connected to the electrical connections from each igniter.

12. The round of claim 11 wherein the circuit board includes a static memory.

13. The round of claim 1 wherein a bore of the launch tube is rifled.

14. A method, comprising:

providing a conventional gun having an electrical pulse firing mechanism;

loading the gun with the round of claim 1; and operating the firing mechanism of the gun in a conventional manner.

15. The method of claim 14 wherein the step of operating the firing mechanism includes operating the firing mechanism sequentially wherein each operation of the firing mechanism causes one of the plurality of projectiles to be launched.

16. An electrically-fired round, comprising:

a case sized to fit in a conventional gun;

a launch tube disposed in the case;

a plurality of projectiles axially stacked in the launch tube;

each projectile comprising a cylindrical body having a circular lid that closes the forward end and a circular base that closes the rear end, the circular lid and the circular base defining a payload volume therebetween, the circular base including a cavity formed therein with a propellant charge disposed in the cavity;

the launch tube including openings in its sidewall, the openings being disposed adjacent propellant charges of the projectiles, each opening including an igniter;

a case base plate that closes a rear end of the case; and electrical connections between the case base plate and each igniter.

17. The round of claim 16 further comprising additional launch tubes disposed in the case, the additional launch tubes each having a plurality of projectiles axially stacked therein; each projectile comprising a cylindrical body having a circular lid that closes the forward end and a circular base that closes the rear end, the circular lid and the circular base defining a payload volume therebetween, the circular base including a cavity formed therein with a propellant charge disposed in the cavity; each launch tube including openings in its sidewall, the openings being disposed adjacent propellant charges of the projectiles wherein each opening includes an igniter.

18. A method, comprising:

providing a conventional gun having an electrical pulse firing mechanism;

loading the gun with the round of claim 16; and operating the firing mechanism of the gun in a conventional manner.

19. The method of claim 18 wherein the step of operating the firing mechanism includes operating the firing mechanism sequentially wherein each operation of the firing mechanism causes one of the plurality of projectiles to be launched.

20. The round of claim 16 wherein a bore of the launch tube is rifled.

* * * * *